US011408235B2

(12) United States Patent
Thorbjornsson

(10) Patent No.: US 11,408,235 B2
(45) Date of Patent: Aug. 9, 2022

(54) CONNECTORS FOR HIGH TEMPERATURE GEOTHERMAL WELLS

(71) Applicant: ISLENSKAR ORKURANNSOKNIR—ISOR, Reykjavik (IS)

(72) Inventor: Ingolfur Thorbjornsson, Gardabaer (IS)

(73) Assignee: ISLENSKAR ORKURANNSOKNIR—ISOR., Reykjavik (IS)

( * ) Notice: Subject to any disclaimer, the term of this patent is extended or adjusted under 35 U.S.C. 154(b) by 0 days.

(21) Appl. No.: 17/287,712

(22) PCT Filed: Oct. 23, 2019

(86) PCT No.: PCT/IS2019/050013
§ 371 (c)(1),
(2) Date: Apr. 22, 2021

(87) PCT Pub. No.: WO2020/084642
PCT Pub. Date: Apr. 30, 2020

(65) Prior Publication Data

US 2021/0396081 A1 Dec. 23, 2021

(30) Foreign Application Priority Data

Oct. 24, 2018 (IS) ..... 050242

(51) Int. Cl.
*E21B 17/08* (2006.01)
*E21B 17/043* (2006.01)

(52) U.S. Cl.
CPC ..... *E21B 17/08* (2013.01); *E21B 17/043* (2013.01)

(58) Field of Classification Search
CPC ..... E21B 17/08; E21B 17/043
See application file for complete search history.

(56) References Cited

U.S. PATENT DOCUMENTS 1,501,217 A 7/1924 Heeter
3,266,821 A * 8/1966 Safford ..... F16L 15/04 285/40

(Continued)

FOREIGN PATENT DOCUMENTS

CN 102191919 A 9/2011
EP 2893120 B1 9/2017
WO 2017103950 A1 6/2017

OTHER PUBLICATIONS

International Search Report and Written Opinion dated Mar. 12, 2020 for corresponding International Application No. PCT/IS2019/050013.

(Continued)

*Primary Examiner* — Shane Bomar
(74) *Attorney, Agent, or Firm* — Tarolli, Sundheim, Covell & Tummino LLP

(57) ABSTRACT

The invention relates to connectors for casings used in high temperature wells. The connectors of the present invention may be used for connecting casing segments of geothermal or oil wells. The connector is simple in design and able to take up thermal expansion due to temperature change when high temperature media starts to flow through the casings and when the well needs to be cooled down for maintenance. The connector of the present invention uses a new sealing mechanism for preventing leaking during operation.

18 Claims, 4 Drawing Sheets

(56) References Cited

U.S. PATENT DOCUMENTS

| | | | | | |
|---|---|---|---|---|---|
| 3,850,461 | A * | 11/1974 | Fujioka | E21B 17/08 | 285/332.2 |
| 5,006,414 | A * | 4/1991 | Pond, Sr. | B23K 23/00 | 427/190 |
| 5,062,667 | A * | 11/1991 | Miller | E21B 33/038 | 285/381.1 |
| 5,183,268 | A * | 2/1993 | Wong | F16L 17/10 | 277/328 |
| 5,263,748 | A * | 11/1993 | Carstensen | E21B 17/042 | 285/333 |
| 11,041,343 | B2 * | 6/2021 | orbjonsson | E21B 17/07 | |
| 2009/0120648 | A1 * | 5/2009 | Khazanovich | E21B 33/04 | 166/379 |
| 2010/0163250 | A1 * | 7/2010 | Schultz | E21B 17/07 | 166/381 |

OTHER PUBLICATIONS

Icelandic Search Report dated Feb. 15, 2019 for corresponding Application No. SE 201802024.

* cited by examiner

CONNECTORS FOR HIGH TEMPERATURE GEOTHERMAL WELLS

RELATED APPLICATIONS

The present application is a U.S. National Stage application under 35 USC 371 of PCT Application Serial No. PCT/IS2019/050013, filed on 23 Oct. 2019; which claims priority from IS Patent Application No. 050242, filed 24 Oct. 2018, the entirety of both of which are incorporated herein by reference.

FIELD

The invention relates to connectors for casings used in high temperature wells. More specifically the present invention provides connectors and methods for connecting casing segments of wells for temperatures higher than 100° C. such as geothermal or oil wells.

INTRODUCTION

In the field of harvesting geothermal energy, borehole linings and the materials used in linings and connectors for linings has mostly been adapted from the oil and gas industry following the standards of that industry. There is however a huge difference between harvesting geothermal energy on one hand and oil and gas on the other hand, specifically when it comes to the temperature variations in the linings during start up, shutdown or harvesting. The use of concrete between casing to prevent flow of fluid from the strata as well as to ensure that the linings sit tight causes problems when the casings expand during harvesting and potentially retracting when the wells are cooled down for maintenance.

As the concrete fixtures prevent the casings from axial movements, the production liner needs to take up thermal expansion during heating up and production as an increase in compressive strain, which is often well above the yield stress of the steel used for casings. When a borehole has reached operating temperature and the connectors and liners have floated and shortened or collapsed (buckled) due to the overload a balance is established for transfers and load. If the need arise to cool the borehole again, as often as needed for maintenance, the casing has inherently been shorten due to yielding or buckling during heating and working temperature, and then casing segments may as a result, tear out of the connector or break or tear apart themselves. This may render the well damaged with reduced flow or even useless afterwards, but the expense in drilling one well is enormous.

WO 2017/103950 discloses connector for joining casing segment which can take up thermal expansion due to temperature change when high temperature media starts to flow through the casings and when the well needs to be cooled down for maintenance. The lower casing is attached to the connector by a screw tread but the upper casing is attached to an inner slidable member by a screw tread, where the inner slidable member forms a metallic seal with an outer member and where the slidable inner member is able to slide up and down in the upper portion of the connector to respond to expansion or contraction of the casing segments due to temperature changes.

SUMMARY

The present invention provides a connector for joining casing segments in making a casing for oil wells or wells for harvesting geothermal media. The connector is simple in design and is able to take up thermal expansion due to temperature change when high temperature media starts to flow through the casings and when the well needs to be cooled down for maintenance. An inner slidable connection member allows the casing to take up thermal expansion due to temperature change when high temperature media starts to flow through the casings. This will also solve the problem casing segments being torn out of connectors or being torn apart due to thermal contraction when a well that needs to be cooled down or stopped for maintenance or other purposes.

The connector of the present invention is made from three parts, which are connected together through tight axial mating surfaces and radial facing surfaces. The connector preferably has one sacrificial seal or gasket in a space between the connection portions of the casings and a metal seal ring within a spacing of one of the radial facing surfaces. When the connector of the present invention is assembled, the slidable connection portion is placed in the upper portion of the connector and together with seals and gaskets before the lower portion is introduced into the lower opening of the upper portion. The upper and the lower portions are then pressed together and fixed together by welding or pins (dovel pins). The metal seal ring in the spacing between the inner radial facing surfaces forms a seal between the two portions when the two portions are pressed together during assembly.

The connector and the use there of provide a new and improved method of providing tight connections between casing segments in boreholes for high temperature media. In some embodiments of the present invention, the following features may be employed: a) a connector for joining casing segments where the connector provides a metal to metal seal in the connector with low hardness metal seal ring placed in a spacing, where the seal is pressed in axial direction of the casing and deformed by the pressure applied to it during assembly. The deformation of seal means that sealing is ensured of the two casing segments by means of the connector; b) the metal used for the metal seal ring in the casing is a low hardness of seal having preferably around 10-20% of the hardness of the material of the connector; c) the metal used for the metal seal ring in the casing has an increased thermal expansion coefficient such that the seal will expand more than the metal in the coupling as high temperature media starts flowing through the connector. The expansion will ensure increased pressure between sealing walls of the coupling. Herein, higher thermal expansion coefficient preferably means more than 50% higher than of the steel used in the connector; and d) the metal used for the metal seal ring in the casing has a high temperature resistance, i.e. the metal seal ring can withstand and ensure tight connection up to, but not limited to, 600° C. Therefore, the melting point of the material used is higher than 600° C., where the high melting point, ensures that seal will maintain its sealing capacity in higher temperatures up to 600° C.

It is an object of the present invention to overcome and/or ameliorate the aforementioned drawbacks of the prior art and to provide an improved and/or alternative and/or additional device or method for connecting casings used in drilling geothermal or oil wells and transport of geothermal media, oil or gas, using a new connector of the present invention. It is one preferred object of the present invention to provide a connector for connecting casings in geothermal or oil wells where the connectors take up both expansion and contraction of the casings as a result of temperature change, when the wells heat up and cool down again. Moreover, it is a preferred object of the present invention to provide a connector having temperature reacting metallic seal properties to prevent leaking.

The object(s) underlying the present invention is (are) particularly solved by the features defined in the independent claims. The dependent claims relate to preferred embodiments of the present invention. Further additional and/or alternative aspects are discussed below.

Thus, at least one of the preferred objects of the present invention is solved by a connector for connecting casing segments used in wells drilled in high temperature areas and for transport of high temperature media. The connector has a hollow tubular main body with an upper portion comprising a first tubular sleeve opening for receiving and engaging to a first casing and a lower portion comprising a second tubular sleeve opening for receiving and engaging to a second casing. As the first and the second portions are assembled to form the connector, an annular spacing is formed in the upper portion axially extending between an inwardly extending upper rim of the upper portion in proximity to the first tubular sleeve opening and an inwardly extending central rim formed in the upper part of the lower portion of the hollow tubular main body. The connector further comprises a slidable connection member extending radially within the annular spacing of the upper portion, where the slidable connection member comprises a first circumferential engaging zone for engaging a mating engaging zone of an end of said first casing and wherein the slidable connection member further comprises an abutting inwardly extending rim which contacts the peripheral end surface of the first casing when the first casing is fully attached to the connector. The slidable connection member is shorter in the axial direction than the annular spacing and is reversibly slidable within annular spacing between the inwardly extending upper rim of the upper portion and the inwardly extending central rim in the upper part of the lower portion of the hollow tubular main body. The connector further comprises a second circumferential engaging zone in the lower portion of the hollow tubular main body in proximity to the second tubular sleeve opening for engaging a mating engaging zone of an end of the second casing. Furthermore, the upper portion and the lower portion of the hollow tubular main body are connected by at least two parallel surfaces as the connector is assembled, where the at least two parallel surfaces are i) first axial mating surfaces, where the upper portion meets the inwardly extending central rim formed in the upper part of the lower portion of the hollow tubular main body, wherein the upper portion and the lower portion are secured or fixed together during assembly, and ii) first radial facing surfaces adjacent to the first axial mating surfaces forming a spacing between the first radial facing surfaces. Furthermore, a metal seal ring is positioned in the spacing between the first radial facing surfaces for forming a seal when axial pressure is applied to the connector during assembly and when high temperature media starts to flow through the connector.

This means that during assembly of the connector, the upper portion and the lower portion of the hollow tubular main body connect through first axial mating surfaces which are positioned where the upper portion meets the inwardly extending central rim formed in the upper part of the lower portion of the hollow tubular main body. The a further connection is made through first radial facing surfaces adjacent to the first axial mating surfaces forming a spacing between the first radial facing surfaces, where a metal seal ring is positioned in the spacing between the first radial facing surfaces for forming a metallic seal when axial pressure is applied to the connector during assembly and when high temperature media starts to flow through the connector.

Another preferred object of the present invention is solved by a method for producing a connector for connecting casing segments used in wells drilled in high temperature areas and for transport of high temperature media. The method comprises: a) providing a hollow tubular main body further comprising; i) an upper portion comprising a first tubular sleeve opening for receiving and engaging to a first casing, said upper portion further comprising an annular spacing axially extending between an inwardly extending upper rim of the upper portion in proximity to the first tubular sleeve opening and an inwardly extending central rim formed in the upper part of the lower portion of the hollow tubular main body, and ii) a lower portion comprising a second tubular sleeve opening for receiving and engaging to a second casing, said lower portion further comprising a second circumferential engaging zone in proximity to the second tubular sleeve opening, for engaging a mating engaging zone of an end of the second casing. The method further comprises b) radially positioning a slidable connection member within the annular spacing, said slidable connection member comprising a first circumferential engaging zone for engaging a mating engaging zone of an end of said first casing, said slidable connection member further comprising an abutting inwardly extending rim that contacts the peripheral end surface of the first casing when the first casing is fully attached, and wherein the slidable connection member is shorter in the axial direction than the annular spacing and is reversibly slidable within annular spacing between the inwardly extending upper rim and the inwardly extending central rim, and c) connecting the upper portion and the lower portion of the hollow tubular main body by engaging at least two parallel surfaces of the connector and applying an axial force onto the connector during assembly, where the at least two parallel surfaces engaged are: I) first axial mating surfaces, where the upper portion meets the inwardly extending central rim formed in the upper part of the lower portion of the hollow tubular main body 1, wherein the upper portion and the lower portion are secured or fixed together during assembly, and II) first radial facing surfaces adjacent to the first axial mating surfaces forming a spacing between the first radial facing surfaces. Finally, the method comprises: d) placing a metal seal ring in the spacing between the first radial facing surfaces prior to assembly for forming a seal when the axial pressure is applied to the connector and when high temperature media starts to flow through the connector.

All embodiments listed herein relate to objects of both the devices and the methods of the present invention.

In an embodiment of the present invention the first portion and the second portion of the hollow tubular main body are connected by further two mating or facing surfaces, namely iii) second axial mating surfaces below the first radial facing surfaces, where the second axial mating surfaces extending diagonally away from the first radial mating surfaces and iv) second radial facing surfaces below the second axial mating surfaces forming a spacing between the mating surfaces opening out to the exterior of the hollow tubular main body.

In an embodiment of the present invention the attachment or fixing of the first axial mating surfaces during assembly is facilitated by welding, dovel pins or other means to prevent movement between the first and the second portions along the first axial mating surfaces after assembly.

In an embodiment of the present invention the melting point of the metal seal ring is higher than 600° C.

In an embodiment of the present invention the seal material used in the metal seal ring is selected from the group of, but not limited to: Aluminium, Zink, Copper, Magnesium or alloys thereof in order to prevent galvanic corrosion.

In an embodiment of the present invention the seal material used in the metal seal ring is Aluminium alloy ASTM 1100 (99% aluminium).

In an embodiment of the present invention the circumferential engaging zones of the upper portion and the lower portion are screw threads.

In an embodiment of the present invention the outer surface of the slidable connection member and the inner surface of upper portion of the hollow tubular main have restrictive structural formations to restrict rotation between the connection member and the upper portion around the length of the casing.

In an embodiment of the present invention the structural formations to restrict rotation between the connection member and the inner surface of upper portion around the length of the casing comprise protrusions in one member and respective depressions in the other member or slight elliptical circumference in the mating surfaces of the two members.

In an embodiment of the present invention the high temperature media comprises one or more of oil, steam, water or brine.

In an embodiment of the present invention the assembly and connection of the upper portion and the lower portion of the hollow tubular main body further comprises the step of securing or fixing of the first axial mating surfaces by welding, dovel pins or other fastening/securing means to further ensure no leaking through the connector.

In an embodiment of the present invention the method of assembly further comprises the step of connecting further two parallel surfaces of the upper portion and the lower portion of the hollow tubular main body, where the two parallel surfaces are i) second axial mating surfaces below the first radial mating surfaces, where the second axial mating surfaces extend diagonally away from the first radial mating surfaces, and ii) second radial facing surfaces below the second axial mating surfaces forming a spacing between the facing surfaces opening out to the exterior of the hollow tubular main body.

In an embodiment of the present invention the axial force applied to the connector during assembly is in the range of 10-150 ton.

In an embodiment of the present invention the outer surface of the hollow tubular main body is kept cold and the inner surface of the hollow tubular main body is kept warm during assembly to ensure better connection of the axial mating surfaces.

In an embodiment of the present invention the method of assembly further comprises the step of placing a sacrificial seal/gasket between said inwardly extending central rim and the slidable connection member during assembly.

The present invention provides a connector for connecting casing segments used in high temperature areas and transport of high temperature media through the casings without failure in the casing when the casing string is cooled down as in case of maintenance, and then heated up again for production. The connector is hollow tubular main body assembled from a upper portion having a first tubular sleeve opening for connecting an upper casing and a lower portion having a second tubular sleeve opening for connecting to a lower casing. During assembly of the first and the lower portions to form the connector, an annular spacing is formed in the inner periphery of the upper portion axially extending between an inwardly extending upper rim of the upper portion in proximity to the first tubular sleeve opening and an inwardly extending central rim formed in the upper part of the lower portion of the hollow tubular main body. A slidable connection member having a first circumferential engaging zone for engaging a mating engaging zone of an end of the upper casing is placed radially within the annular spacing of the upper portion during assembly. The slidable connection member is shorter in the axial direction than the annular spacing and is reversibly slidable within annular spacing between the inwardly extending upper rim of the upper portion and the inwardly extending central rim in the upper part of the lower portion of the hollow tubular main body. The slidable connection member comprises an abutting inwardly extending rim which contacts the peripheral end surface of the first casing when the first casing is fully attached to the connector. The connector further comprises a second circumferential engaging zone in the lower portion of the hollow tubular main body in proximity to the second tubular sleeve opening for engaging a mating engaging zone of an end of the lower casing. When the connector is assembled, the upper portion and the lower portion of the hollow tubular main body are connected by at four mating surfaces, namely i) first axial mating surfaces positioned where the upper portion meets the inwardly extending central rim formed in the upper part of the lower portion of the hollow tubular main body, where the upper portion and the lower portion are secured or fixed together, ii) first radial mating surfaces adjacent to the first axial mating surfaces forming a spacing between the first radial mating surfaces, iii) second axial mating surfaces below the first radial mating surfaces, where the second axial mating surfaces extending diagonally away from the first radial mating surfaces and iv) second radial mating surfaces below the second axial mating surfaces forming a spacing between the mating surfaces opening out to the exterior of the hollow tubular main body. Furthermore, a metal seal ring is positioned or placed in the spacing between the first radial mating surfaces during assembly for forming a seal in the axial direction of the connector during expansion of the casing.

In an embodiment of the present invention the distance, of which the slidable connection member is slidable within the upper portion is calculated as the distance which one casing expands due to the temperature increase in the environment of pumping up geothermal media or oil. If the well needs to be cooled down for maintenance, the casings are able to contract back to the length during mounting due to the allowable sliding length within the connector.

In an embodiment of the present invention the connector further comprises a sacrificial seal or gasket between inwardly extending central rim formed in the slidable connection member of the upper portion and the inwardly extending central rim formed in the upper part of the lower portion during mounting.

In an embodiment of the present invention the longitudinal thickness of the sacrificial seal or gasket is similar to the distance between the inwardly extending central rim formed in slidable connection member of the upper portion and the inwardly extending central rim formed in formed in the upper part of the lower portion during mounting, when the slidable connection member sits in mounting seat.

In an embodiment of the present invention the sacrificial seal or gasket melts away due to heating of the casing wherein the connecting portion of the slidable connection member is positioned in connecting seat.

In an embodiment of the present invention the casings are connected by threaded connections before they are lowered down into a borehole using screw thread in the outer circumference of the casing and in the inner circumference of the connector.

In an embodiment of the present invention the upper and lower portions of the hollow tubular main body are formed as a as two objects and then attached together by welding, pins or by other means to lock its movement, in order to fit the slidable connection member, sacrificial seal or gasket and the metal seal ring into the construction.

In an embodiment of the present invention the outer surface of the slidable connection member and the inner surface of upper portion form a metallic seal in an open mounting position.

In an embodiment of the present invention the connector provides a metal to metal seal in the connector with low hardness metal seal placed in a spacing, where the seal is pressed in axial direction of the casing and deformed by the pressure applied to it, and wherein the deformation of seal means that sealing is ensured of the two casing segments by means of the connector.

In an embodiment of the present invention the metal used for the metal seal ring in the casing is a low hardness of seal having preferably around 10-20% of the hardness of the material of the connector and can withstand high deformation without cracking.

In an embodiment of the present invention the metal used for the metal seal ring in the casing has an increased thermal expansion coefficient such that the seal will expand more than the metal in the coupling. In further embodiments, the expansion will ensure increased pressure between sealing walls of the coupling. Preferably, higher thermal expansion coefficient means, but not limited to, 50% higher than of steel used in the connector.

In an embodiment of the present invention the metal used for the metal seal ring in the casing has a high temperature resistance, i.e. the metal seal ring can withstand and ensure tight connection up to, but not limited to, 600° C. In such an embodiment, the melting point of the material used is higher than 600° C., but with a high melting point, it is ensured that seal will remain its sealing capacity in higher temperatures up to 600° C.

In an embodiment of the present invention high axial pressure is applied to the metal seal in the connector during assembly.

In an embodiment of the present invention the seal material used in the metal seal ring is selected to be without risk of galvanic corrosion of the material used for couplings prior to or during use in high temperature applications. Preferably the sealing material is below steel in the galvanic corrosion chart/table.

In an embodiment of the present invention the outer surface of the slidable connection member and the inner surface of upper portion together with the bottom surface of the abutting inwardly extending rim of the slidable connection member and the top surface of the inwardly extending central rim of the lower portion of the hollow tubular main body form a metallic seal in a connecting position.

In the present context the term "high temperature media" refers to geothermal media, gas or oil. The device and method of the present invention is designed to work in wells in high temperature areas of 100° C. or more, where the temperature change in the casings between well completion and production differs more than 50° C., such as 100° C., 150° C., 200° C., 250° C., 300° C., or even 450° C.

In the present context the term "hollow tubular main body" refers to the connector itself, being an annular connector for joining two pipes or casing segments in wells drilled in high temperature areas and/or for transport of high temperature media. Each connector or hollow tubular main body comprises two portions which are connected with some kind of attaching means, such as welding or pins. As the connector has an inner slidable connection member and one or more seals it needs to be made from at least two different portions.

In the present context the terms "upper portion", "upper portion of the hollow tubular main body" and "first portion" all relate to the same part of the connector, namely the portion of the connector which connects to the upper casing segment of two casing segments being connected in a casing in wells drilled in high temperature areas and for transport of high temperature media.

In the present context the terms "lower portion", "lower portion of the hollow tubular main body" and "second portion" all relate to the same part of the connector, namely the portion of the connector which connects to the lower casing segment of two casing segments being connected in a casing in wells drilled in high temperature areas and for transport of high temperature media.

In the present context the terms "attaching", "joining", "engaging", and "connecting" casing segments define the attachment of two casings by the connector of the present invention. In some embodiments the casings are screwed into each end of the connector and thereby the casings are connected or attached together.

In the present context the term "reversibly slidable within annular spacing" refers to the slidable connection member and its axial sliding movement up and down the annular spacing within the upper portion. As the slidable connection member of the upper portion of the hollow tubular main body, which is shorter than the outer support member and is slidably or reversibly movable in the axial direction of the casings within the outer support member. This means that after mounting and after the sacrificial seal/gasket has melted away, the upper casing can move back and forth in the connector in the direction of the casing as a result of expansion and contraction of the casings as a result of temperature change. This temperature difference can be between 300-450° C. or low as 150. Therefore, when the casing segments expand and retract during operation and maintenance of the piping, the inner slidable member is able to reversibly slide within the connector without tearing the connection's apart. The outer surface of the slidable connection member is closely fitted within the outer part of the upper portion and therefore forming a metallic seal as with the inner surface of upper portion.

In the present context the term "metallic seal" refers to a condition where two metallic surfaces are so closely arranged that they form a seal between them. This seal prevents the casings joined by the seal to leak geothermal media as well as prevent dirt and other debris to get into the casing. Furthermore, a metal to metal seal is provided in the connector with low hardness metal seal ring placed in a radial spacing, where the seal is pressed in axial direction of the casing and deformed by the pressure applied to it.

In the present context the terms "mounting position", "cold position", "open position" and "maintenance position" refer to a position where the connector is connecting two casings and where the upper end of the slidable connection member is up against the upper inwardly extending upper rim of the upper portion forming a gap between the abutting inwardly extending rim of the slidable connection member of the upper portions sleeve opening and the inwardly extending central rim of the lower portion. During mounting a sacrificial seal/gasket fills this gap, but this gasket melts away due to heating of the casing when high temperature geothermal media flows through casing. In this position the casings are at a colder temperature, such as during mounting or when the well is being cooled down for maintenance. In this position, a metallic seal is formed by the outer surface of the slidable connection member and the inner surface of outer upper portion of the hollow tubular main body.

In the present context the terms "operating position", "closed position", "connecting position" and "hot position" refer to a position where the connector is connecting two casings and where the abutting inwardly extending rim of the slidable connection member is up against the inwardly extending central rim of the lower portion of the hollow tubular main body, closing a gap between the inwardly extending lower rim of the slidable connection member of the upper portion and the inwardly extending central rim of the lower portion of the hollow tubular main body. Here the sacrificial seal/gasket has melted away. In this position the casings are at a very high temperature, such as during pumping of geothermal media through the casing. In these position a metallic seal is formed by the outer surface of the slidable connection member and the inner surface of outer upper portion of the hollow tubular main body together with the bottom surface of the abutting inwardly extending rim of the slidable connection member and the top surface of the inwardly extending central rim of the second portion of the hollow tubular main body.

In the present context the term "parallel surfaces" refers to two surfaces of two individual components of the connector of the present invention, which have parallel positions when the connector is being or is assembled. In the present context the term "parallel" means almost or fully parallel, i.e. for flat surfaces their degree angle in axial and/or radial direction is almost the same or exactly the same.

In the present context the term "mating surfaces" refers to two surfaces of two individual components having matching or aligning shape and position, such that when assembled together or connected the two surfaces fit or align perfectly together and leave no space between them.

In the present context the term "facing surfaces" refers to two opposing surfaces of two individual components, such that when assembled together or connected the two surfaces face each other leaving a space between them.

The connector of the present invention solves the problem of leaking between the axial connecting surfaces of the individual components of the connector during operation. The connector disclosed herein is assembled from different components, where an upper and a lower portion (component) are connected and the lower portion has a screw thread to connect to a lower casing, but the upper portion has an inner slidable member which connects to the upper casing. This provides a connector which can take up expansion and contraction between use and maintenance of a borehole. The problem is solved by a design where the first portion and the second portion of the hollow tubular main body are connected by at least two mating or facing surfaces as the connector is assembled. The first axial mating surfaces are where the upper portion meets the inwardly extending central rim formed in the upper part of the lower portion of the hollow tubular main body. There is a tight fit between these surfaces, and they are further secured or fixed together during assembly using dovel pins or welding. The first radial facing surfaces are adjacent or below to the first axial mating surfaces and form a spacing between them to house a metal seal ring in the spacing. The metal seal ring forms a seal when axial pressure is applied to the connector during assembly as it is made of a metal having low hardness properties. The sealing properties of the metal seal ring are further enhanced when high temperature media starts to flow through the connector as the ring will expand more than the metal in the coupling as the metal used for the metal seal ring has an increased thermal expansion coefficient. The expansion of the metal seal ring will further ensure that there is no leaking between the components making up the connector. Additionally, in a preferred embodiment the first portion and the second portion of the hollow tubular main body are connected by further two mating or facing surfaces. The second axial mating surfaces are below the first radial facing surfaces, extending diagonally towards the exterior of the connector away from the first radial mating surfaces. The diagonal formation provides a connecting and sealing function as axial pressure is applied to the upper and the lower portion of the connector during assembly. The second radial facing surfaces are below the second axial mating surfaces forming a spacing between them and open out to the exterior of the hollow tubular main body. The spacing is wide enough so that the second radial facing surfaces do not connect when axial pressure is applied during assembly ensuring a tight connection between the two second axial mating surfaces.

BRIEF DESCRIPTION OF THE DRAWINGS

The skilled person will understand that the drawings, described below, are for illustration purposes only. The drawings are not intended to limit the scope of the present teachings in any way.

DESCRIPTION OF VARIOUS EMBODIMENTS

In the following, exemplary embodiments of the invention will be described, referring to the figures. These examples are provided to provide further understanding of the invention, without limiting its scope.

It should be appreciated that the invention is applicable for connecting casing segments in general in borehole for utilizing high temperature media, such as oil and geothermal media. Further, the connector, a system and the method according to the invention is illustrated in the embodiments that follow with a preferred embodiment of geothermal borehole, but it should be appreciated that the invention is also applicable to drilling for other purposes such as oil wells.

For the drawings below the embodiments show a connector where the sliding inner member is attached to the upper casing during drilling and assembly. The skilled person will appreciate that the connector can be used such that the sliding inner member is attached to the lower casing during drilling and assembly.

Figure 1:
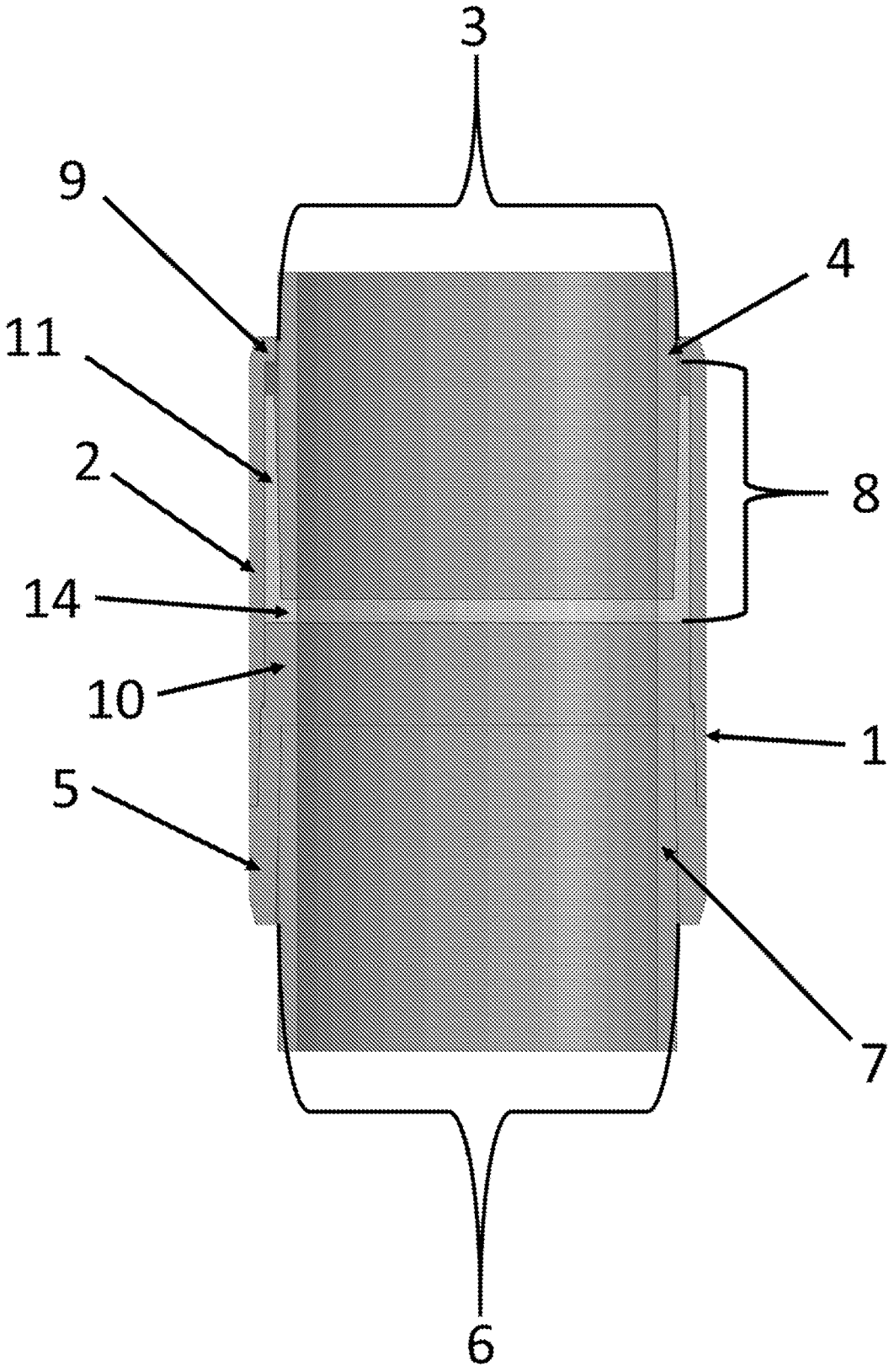
FIG. 1 shows a transection of two casings being connected by the connector of the invention in a connection position outlining the individual parts of the connector.

FIG. 1 is a schematic drawing of a connector for connecting two casings. The drawing is a transactional view of a connector having a hollow tubular main body 1 with an upper portion 2 having a first tubular sleeve opening 3 to be attached to first casing 4 and a lower portion 5 having a second tubular sleeve opening 6 to be attached to a second casing 7. An annular spacing 8 is formed in the upper portion 2 of the hollow tubular main body 1 axially extending between an inwardly extending upper rim 9 in at the first tubular sleeve opening 3 and an inwardly extending central rim 10 formed in the upper part of the lower portion 5 of the hollow tubular main body 1. A slidable connection member 11 is arranged and extending axially within the spacing 8. The slidable connection member 11 comprises an abutting inwardly extending rim 14 that makes contact with the peripheral end surface of the first casing 4 when the first casing 4 is fully attached. The slidable connection member 11 is shorter in the axial direction than the annular spacing 8 and is reversibly slidable within annular spacing 8 between the inwardly extending upper rim 9 and the inwardly extending central rim 10 when the casing extends and retracts due to temperature change.

Figure 2:
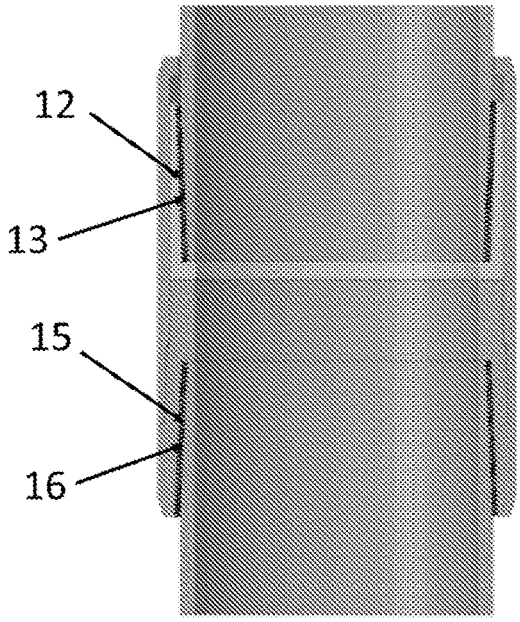
FIG. 2 shows a transection of two casings being connected by the connector of the invention in a connection position outlining the engaging zones of the connector.

FIG. 2 shows the engaging zones for connecting two casings into the connector of the present invention. The slidable connection member 11 comprises a first circumferential engaging zone 12 for engaging a mating engaging zone 13 of the connecting end of the first casing 4. The lower portion 5 of the hollow tubular main body 1 comprises a second circumferential engaging zone 15 for engaging a mating engaging zone 16 at the end of the second casing 7.

Figure 3:
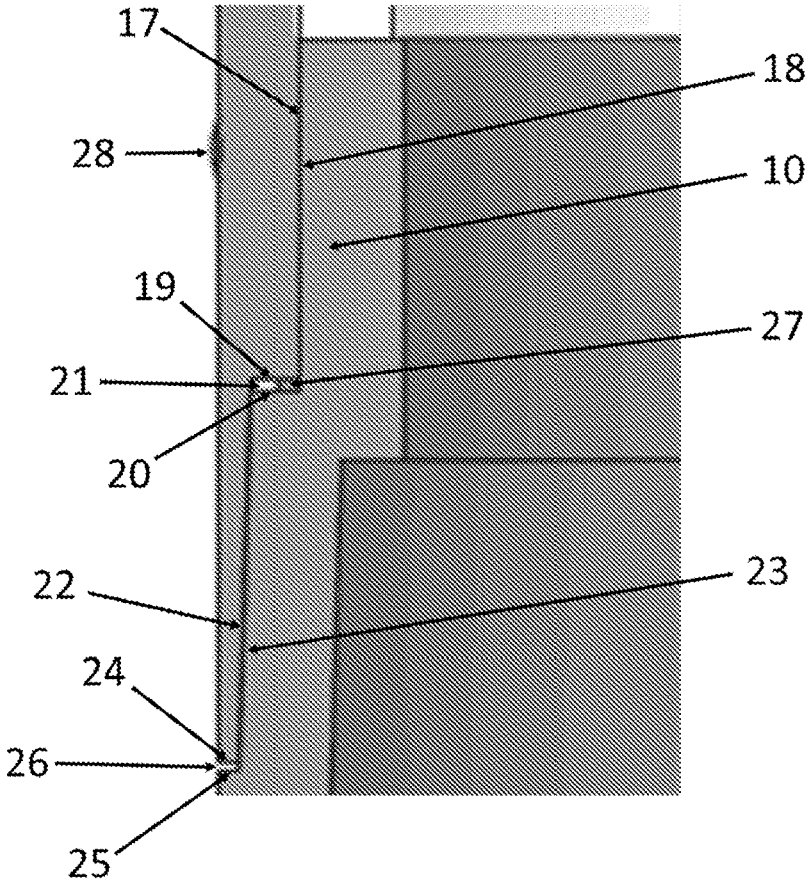
FIG. 3 is a transection of the four mating zones where the upper and lower portions of the connector are joined.

FIG. 3 is a schematic drawing showing the connecting surfaces of the first portion 2 and the second portion 3 of the hollow tubular main body 1. The first 2 and the second 5 portions are connected by four mating surfaces. The first mating surfaces are axial mating surfaces 17, 18 where the upper portion 2 meets the inwardly extending central rim 10 formed in the upper part of the lower portion 5 of the hollow tubular main body 1. The part of the connector, where the axial mating surfaces 17 and 18 connect is a part of the connector where there is now axial sliding between the first portion 2 and the second portion 3 of the hollow tubular main body 1. Therefore, the upper portion 2 and the lower portion 5 are secured or fixed together by means of pins or welding. In the embodiment shown in FIG. 3, the axial movement between the first portion 2 and the second portion 3rd attachment between them is secured by pins 28. Below the first axial mating surfaces, which are parallel to the direction of the casing the inner surface of the upper portion 2 and outer surface of the lower portion 5 take a 90° turn outwardly to form first radial facing surfaces 19 and 20 which form a spacing 21 between the facing surfaces 19 and 20. Thereafter, the inner surface of the upper portion 2 and outer surface of the lower portion 5 take an approximately 90° turn in an axial direction down the connector forming second axial mating surfaces 22, 23 below the first radial facing surfaces 19, 20. The second axial mating surfaces 22, 23 extending diagonally away from the first radial mating surfaces 19, 20 in the direction towards of the exterior of the connector. Finally, the inner surface of the upper portion 2 and outer surface of the lower portion 5 take an approximately 90° turn second radial facing surfaces 24, 25 below the second axial mating surfaces 22, 23 forming a spacing 26 between the facing surfaces 24, 25 opening out to the exterior of the hollow tubular main body 1. The drawing also shows a metal seal ring 27 is positioned in the spacing 21 for forming a seal in the axial direction of the connector during expansion of the casing. When the casing to take up thermal expansion due to temperature change when high temperature media starts to flow through the casings the upper portion 2 and presses against the lower portion 5 and the metal seal ring 27 in the spacing 21 forms a seal between the two portions making up the connector.

Figure 4:
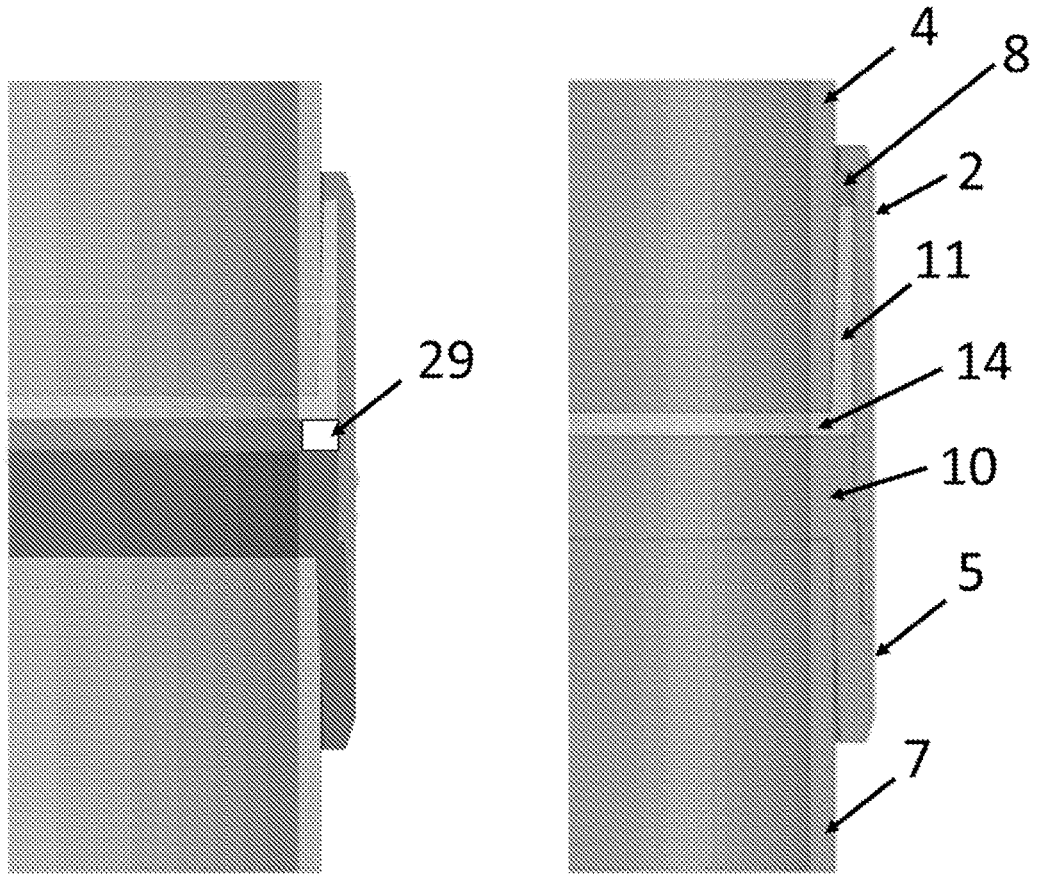
FIG. 4 shows a transection of two casings being connected by the connector of the invention in mounting position (FIG. 4A) and in connection position (FIG. 4B) showing the sacrificial gasket.

FIG. 4 shows in transection how two casings have been connected by the connector in an (open) mounting or maintenance position (FIG. 4A) and in a (closed) connecting or operating position (FIG. 4B). The drawing shows casing 4 and 7 being attached to the upper 2 and the lower 5 portions of the connector, where the upper casing is attached to the slidable connection member 11 of the upper portion 2. In FIG. 4 the slidable connection member 11 is in the mounting position and as it is shorter than the annular spacing 8 formed in the upper portion 2 of the hollow tubular main body 1, a gap is formed between the abutting inwardly extending rim 14 of the slidable connection member 11 and the inwardly extending central rim 10 of the lower portion 5. The drawing shows a sacrificial seal/gasket 29 in the gap formed between the abutting inwardly extending rim 14 of the slidable connection member 11 and the inwardly extending central rim 10 of the lower portion 5 which melts away when hot media starts to flow through the casing. In FIG. 4B the sacrificial seal/gasket 29 has melted and the slidable connection member 11 has been pushed towards the inwardly extending central rim 10 of the lower portion 5.

Figure 5A:
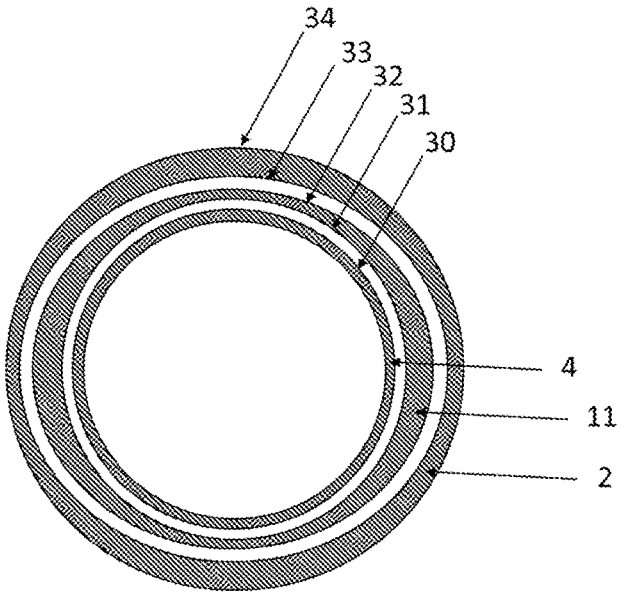
FIG. 5 shows two embodiments for providing restrictive structural formations to restrict rotation around the length of the casing.

FIG. 5A shows a cross-sectional view of a first casing 4 being secured into the connector 1. The space between the casing and the inner member as well as the space between the slidable connection member 11 and the upper portion 2 of the hollow tubular main body is exaggerated to outline the restrictive structural formations to restrict rotation around the length of the casing. The outer surface 30 of the casing 4 is secured to the inner surface 31 of slidable connection member 11 by a screw thread for example. The outer surface 32 of the slidable connection member 11 and the inner surface 33 of upper portion 2 of the hollow tubular main body have an elliptical shape in this embodiment to prevent rotation around the length of the casing, whereas the outer surface 30 of the casing 4 and the inner surface 31 of the slidable connection member 11 are completely circular to provide connectivity by screwing the two components together. The outer circumference 34 of the upper portion 2 of the hollow tubular main body is also shown as circular. It should be noted that only a small degree of elliptical shape is required to prevent rotation around the length of the casing, but this is exaggerated in this drawing for demonstrational purposes.

Figure 5B:
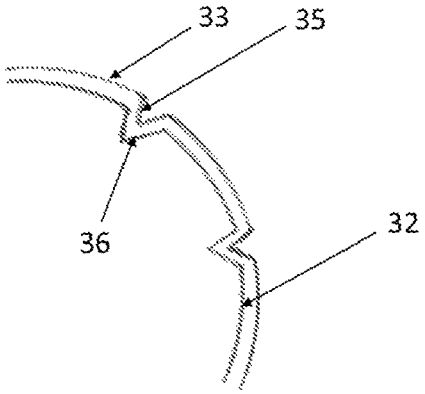

In FIG. 5B, a different type of restrictive structural formations is shown. The mating surfaces of outer surface 32 of the slidable connection member 11 and the inner surface 33 of upper portion 2 of the hollow tubular main body by providing mating protrusions 35 in the inner surface 33 of upper portion 2 and to depressions 36 in the outer surface 32 of the slidable connection member 11.

Figure 6:
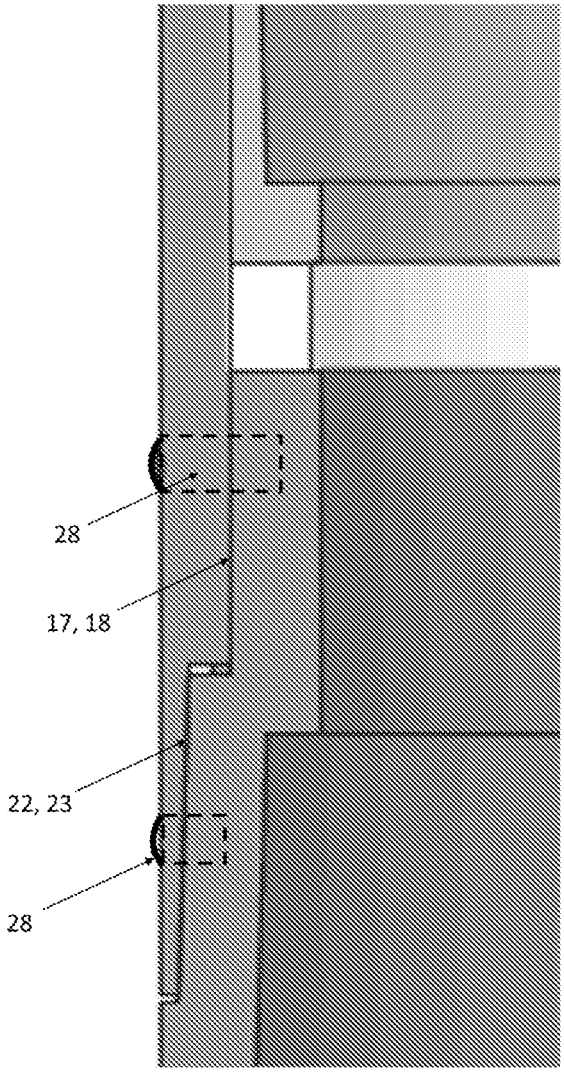
FIG. 6 shows how the components of the connectors are secured together during an assembly process and the connection of the upper and the lower portion of the connector.

In FIG. 6 it is demonstrated how the components of the connectors are secured together in the assembly process and connection of the upper portion and the lower portion of the hollow tubular main body. In order to further ensure no leaking through the connector the first axial mating surfaces 17,18 by dovel pins 28 in the embodiment shown in FIG. 6.

During the assembly the outer surface of the hollow tubular main body is kept cold and the inner surface of the hollow tubular main body is kept warm to facilitate the fitting of the lower portion into the upper portion and to better ensure connection of the axial mating surfaces. The assembly process further comprises applying axial force to the connector in the range of 10-150 ton, preferably around 100 ton. The tightness of the connector can be secured even more during assembly by securing or fixing the second axial mating surfaces 22, 23 together by dovel pins 28.

As used herein, including in the claims, singular forms of terms are to be construed as also including the plural form and vice versa, unless the context indicates otherwise. Thus, it should be noted that as used herein, the singular forms "a," "an," and "the" include plural references unless the context clearly dictates otherwise.

Throughout the description and claims, the terms "comprise", "including", "having", and "contain" and their variations should be understood as meaning "including but not limited to", and are not intended to exclude other components.

The present invention also covers the exact terms, features, values and ranges etc. in case these terms, features, values and ranges etc. are used in conjunction with terms such as about, around, generally, substantially, essentially, at least etc. (i.e., "about 3" shall also cover exactly 3 or "substantially constant" shall also cover exactly constant).

The term "at least one" should be understood as meaning "one or more", and therefore includes both embodiments that include one or multiple components. Furthermore, dependent claims that refer to independent claims that describe features with "at least one" have the same meaning, both when the feature is referred to as "the" and "the at least one".

It will be appreciated that variations to the foregoing embodiments of the invention can be made while still falling within the scope of the invention can be made while still falling within scope of the invention. Features disclosed in the specification, unless stated otherwise, can be replaced by alternative features serving the same, equivalent or similar purpose. Thus, unless stated otherwise, each feature disclosed represents one example of a generic series of equivalent or similar features.

Use of exemplary language, such as "for instance", "such as", "for example" and the like, is merely intended to better illustrate the invention and does not indicate a limitation on the scope of the invention unless so claimed. Any steps described in the specification may be performed in any order or simultaneously, unless the context clearly indicates otherwise.

All of the features and/or steps disclosed in the specification can be combined in any combination, except for combinations where at least some of the features and/or steps are mutually exclusive. In particular, preferred features of the invention are applicable to all aspects of the invention and may be used in any combination.

The invention claimed is:

1. A connector for connecting casing segments used in wells drilled in high temperature areas and for transport of high temperature media, the connector comprising:

a) a hollow tubular main body with an upper portion comprising a first tubular sleeve opening for receiving and engaging to a first casing, a lower portion comprising a second tubular sleeve opening for receiving and engaging to a second casing, and an annular spacing in the upper portion axially extending between an inwardly extending upper rim of the upper portion in proximity to the first tubular sleeve opening and an inwardly extending central rim formed in the upper part of the lower portion of the hollow tubular main body, b) slidable connection member extending radially within the annular spacing, said slidable connection member comprising a first circumferential engaging zone for engaging a mating engaging zone of an end of said first casing, wherein the slidable connection member comprises an abutting inwardly extending rim that contacts the peripheral end surface of the first casing when the first casing is fully attached, and wherein the slidable connection member is shorter in the axial direction than the annular spacing and is reversibly slidable within annular spacing between the inwardly extending upper rim and the inwardly extending central rim, and c) second circumferential engaging zone in the lower portion of the hollow tubular main body in proximity to the second tubular sleeve opening, for engaging a mating engaging zone of an end of the second casing, wherein the upper portion and the lower portion of the hollow tubular main body are connected by at least two parallel surfaces as the connector is assembled, said at least two parallel surfaces being:

i) first axial mating surfaces being where the upper portion meets the inwardly extending central rim formed in the upper part of the lower portion of the hollow tubular main body, when the upper portion and the lower portion are secured or fixed together during assembly, and ii) first radial facing surfaces adjacent to the first axial mating surfaces forming a spacing between the first radial facing surfaces, wherein a metal seal ring is positioned in the spacing between the first radial facing surfaces for forming a seal when axial pressure is applied to the connector during assembly and when high temperature media starts to flow through the connector, and wherein the first portion and the second portion of the hollow tubular main body are connected by further two parallel surfaces, said two parallel surfaces being:

iii) second axial mating surfaces below the first radial mating surfaces, said second axial mating surfaces extending diagonally away from the first radial mating surfaces, and iv) second radial facing surfaces below the second axial mating surfaces forming a spacing between the facing surfaces opening out to the exterior of the hollow tubular main body.

2. The connector according to claim 1, wherein the attachment or fixing of the first axial mating surfaces during assembly is facilitated by welding, dovel pins or other means to prevent movement between the first and the second portions along the first axial mating surfaces after assembly.

3. The connector according to claim 1, wherein the melting point of the metal seal ring is higher than 600° C.

4. The connector according to claim 1, wherein the metal seal ring is made from aluminium.

5. The connector according to claim 1, wherein the circumferential engaging zones of the upper portion and of the lower portion are screw threads.

6. The connector according to claim 1, further comprising a sacrificial seal/gasket between said inwardly extending central rim and the slidable connection member.

7. The connector according to claim 1, wherein the outer surface of the slidable connection member and the inner surface of upper portion of the hollow tubular main body have restrictive structural formations to restrict rotation between the connection member and the upper portion around the length of the casing.

8. The connector according to claim 7, wherein the structural formations to restrict rotation between the connection member and the inner surface of upper portion around the length of the casing comprise protrusions in one member and respective depressions in the other member or slight elliptical circumference in the mating surfaces of the two members.

9. The connector according to claim 1, wherein the high temperature media comprises one or more of oil, steam, water or brine.

10. The connector according to claim 1, wherein the seal material used in the metal seal ring is selected from the group of, but not limited to: Aluminium, Zink, Copper, Magnesium or alloys thereof.

11. The connector according to claim 10, wherein the seal material used in the metal seal ring is Aluminium alloy ASTM 1100 (99% aluminium).

12. The connector according to claim 1, wherein high axial pressure is applied to the connector during assembly.

13. A method for producing a connector for connecting casing segments used in wells drilled in high temperature areas and for transport of high temperature media, the method comprising:

a) providing a hollow tubular main body further comprising
   i) an upper portion comprising a first tubular sleeve opening for receiving and engaging to a first casing, said upper portion further comprising an annular spacing axially extending between an inwardly extending upper rim of the upper portion in proximity to the first tubular sleeve opening and an inwardly extending central rim formed in an upper part of a lower portion of the hollow tubular main body, and
   ii) the lower portion comprising a second tubular sleeve opening for receiving and engaging to a second casing, said lower portion further comprising a second circumferential engaging zone in proximity to the second tubular sleeve opening, for engaging a mating engaging zone of an end of the second casing, b) radially positioning a slidable connection member within the annular spacing, said slidable connection member comprising a first circumferential engaging zone for engaging a mating engaging zone of an end of said first casing, said slidable connection member further comprising an abutting inwardly extending rim that contacts the peripheral end surface of the first casing when the first casing is fully attached, and wherein the slidable connection member is shorter in the axial direction than the annular spacing and is reversibly slidable within annular spacing between the inwardly extending upper rim and the inwardly extending central rim, c) connecting the upper portion and the lower portion of the hollow tubular main body by engaging at least two parallel surfaces of the connector and applying an axial force onto the connector during assembly, wherein the at least two parallel surfaces engaged are:
   first axial mating surfaces where the upper portion meets the inwardly extending central rim formed in the upper part of the lower portion of the hollow tubular main body, when the upper portion and the lower portion are secured or fixed together during assembly, and
   first radial facing surfaces adjacent to the first axial mating surfaces forming a spacing between the first radial facing surfaces, d) placing a metal seal ring in the spacing between the first radial facing surfaces prior to assembly for forming a seal when the axial pressure is applied to the connector and when high temperature media starts to flow through the connector, and e) connecting further two parallel surfaces of the upper portion and the lower portion of the hollow tubular main body, said two parallel surfaces being:
   iii) second axial mating surfaces below the first radial mating surfaces, said second axial mating surfaces extending diagonally away from the first radial mating surfaces, and
   iv) second radial facing surfaces below the second axial mating surfaces forming a spacing between the facing surfaces opening out to the exterior of the hollow tubular main body.

14. The method according to claim 13, wherein the assembly and connection of the upper portion and the lower portion of the hollow tubular main body further comprises securing or fixing of the first axial mating surfaces together by welding, dovel pins or other securing/fixing means.

15. The method according to claim 13, wherein the axial force applied to the connector during assembly is in the range of 10-150 ton.

16. The method according to claim 13, wherein the outer surface of the hollow tubular main body is kept cold and the inner surface of the hollow tubular main body is kept warm to ensure better connection of the axial mating surfaces during assembly.

17. The method according to claim 13, wherein the assembly and connection of the upper portion and the lower portion of the hollow tubular main body further comprises securing or fixing the second axial mating surfaces together by dovel pins or other securing/fixing means.

18. The method according to claim 13, further comprising the step of placing a sacrificial seal/gasket between said inwardly extending central rim and the slidable connection member during assembly.

* * * * *